US005261178A

United States Patent [19]

Samish

[11] Patent Number: 5,261,178

[45] Date of Patent: Nov. 16, 1993

[54] MAGNETIC HOLDER FOR CARTRIDGE HOLDING DEVICE

[76] Inventor: Peter A. Samish, 11349 Orcas Ave., Lake View Ter., Calif. 91342

[21] Appl. No.: 9,386

[22] Filed: Jan. 27, 1993

Related U.S. Application Data

[63] Continuation-in-part of Ser. No. 881,146, May 11, 1992, abandoned.

[51] Int. Cl.[5] ..... F41A 9/85

[52] U.S. Cl. ..... 42/89; 42/99

[58] Field of Search ..... 42/88, 89, 99

[56] References Cited

U.S. PATENT DOCUMENTS

| | | | |
|---|---|---|---|
| 923,068 | 5/1909 | Neal | 42/89 |
| 3,769,733 | 11/1973 | Nelson | 42/89 |
| 4,079,536 | 3/1978 | Hunt | 42/89 |
| 4,254,571 | 3/1981 | Peter et al. | 42/89 |
| 4,507,889 | 4/1985 | Allen | 42/89 |
| 4,535,558 | 8/1985 | Benesh | 42/89 |
| 4,796,371 | 1/1989 | Daniels | 42/89 |
| 4,934,082 | 6/1990 | Laendler | 42/89 |
| 5,083,393 | 1/1992 | Smydas | 42/89 |

*Primary Examiner*—David H. Brown

[57] ABSTRACT

A substantially cylindrical holding device (22) for loaded half and full moon clips, having a base (10) containing holes (12): which receive cartridges (18) held by half or full moon clips (20): a centrally located substantially cylindrical wheel (16) having a diameter less than the base (10) diameter and nesting the passage of the remainder of the cartridges; has a flat top (16A) which has embedded in it magnets (14) which hold the loaded half or full moon clips to the flat top (16A): where the clips may be easily removed as required; an alternate contains a central recess (26) having a magnetic means (28) which receives the abutment of a speed loader 30 which has been fitted with a metallic means 32.

5 Claims, 2 Drawing Sheets

MAGNETIC HOLDER FOR CARTRIDGE HOLDING DEVICE

This application is a continuation-in-part of application Ser. No. 07/881,146, filed May 11, 1992, now abandoned.

BACKGROUND

1. Field of the Invention

This invention relates to holding devices, specifically to such devices which are used to hold in place cartridge holding devices known as "full moon" clips and "half moon" clips which accept rimmed or non-rimmed firearm cartridges, and also to hold in place cartridge holding devices known as "speed loaders" which hold rimmed firearm cartridges.

2. Description of Prior Art

Half and full moon clips are in the prior art designed to allow non-rimmed firearm cartridges to be fired from firearms that require rimmed cartridges. The half or full moon clips act as an artificial rim for the non-rimmed cartridges.

Recently, half and full moon clips have also been used to hold rimmed cartridges in specially modified firearms. This has provided the advantages of increasing efficiencies in loading and reloading and also has made unecessary the prior art conventional "speed loader" which must be discarded after the cartridges are loaded into the firearms' open cylinder.

Half and full moon clips when filled with cartridges have in the prior art either been held loosely in pockets, or in devices designed to secure loaded half or full moon clips to ones person that would allow rapid access. These have met with very little success because they have relied on spring clips and or moving parts that in fact hinder the very rapid loading or unloading process they are meant to serve.

The long held need for a simple, efficient means to hold half and full moon clips for easy access is shown in the enclosed exhibit A, example of prior art, an article in Guns & Ammo, June 1992, pages 30 and 31, in which an expert in the prior art is attempting to answer a similar question from a reader speaking to this need. It is clear from the experts response that no uniform means is available today to handle the holding of loaded full and half moon clips, nor is any suggestion made by the expert in the prior art to the possibility of such a device as taught in the present invention. Also, substantial problems exist in the prior art in cartridge holding devices which are known as "speed loaders", with respect to their storage and usage. In the prior art of speed loaders, the edge of the pouch in which the speed loaders are stored, is proximate to the top of the speed loader thereby making grasping difficult. Therefore the speed loaders are often lifted by the top cartridge release knob, often accidentally causing the release of cartridges before they are inserted in the cylinder. This can be very dangerous in a critical situation. In the case of a rapid loading situation, in the prior art of speed loaders, if a fumble of manual dexterity occurs, there is a chance that the cartridges would be lost to rapid retrieval.

In high stress situations, fine motor skills are diminished, and if the release knob of the speed loader is mistakenly activated when grasped, and prior to insertion in the cylinder, cartridges can fall back into the holding pouch of the prior art or fall and be lost on the street and cannot be quickly retrieved and loaded.

OBJECTS AND ADVANTAGES

Accordingly, besides the objects and advantages of the magnetic half and full moon clip holding device described in the instant application, several objects and advantages of the present invention are:

In contrast to the problems existing in the prior art of complexity, such as slowness of task completion by need of excessive steps of time and motion of hands, as abovementioned in existing prior art holding devices having complex retaining means, or of an ungainly use of a complex device with moving parts which must be quickly discarded as in prior art "speed loaders", the device of the instant application does not require any moving parts at all.

The device of the instant application is a very simple device which may therefore be easily mounted to a belt similar to those belts in common use for firearm or cartridge holding.

The existing prior art utilizes firearms having modified cylinders being either counterbored to accept full or half moon clips, or being supplied directly from the factory with a cylinder which is pre-machined to allow the use of full or half moon clips.

The existing prior art utilizes "speed loaders" to load a full cylinder of cartridges. The "speed loader" however, which is a active positive locking device using a ball detent and spring means, is a somewhat clumsy and time consuming to use device, as it requires steps using the manual dexterity of hands, in a way which will disengage the process in the "speed loader" which attaches to the grooves in the firearms' cartridge heads, and therefore involves a skill to be employed which extends the complexity and decreases the efficiency of loading a full cylinder with cartridges.

In contrast, the device of the present invention being a passive holding device, does not involve any additional manual dexterity or time and motion of hands techniques beyond those already used in picking up a loaded half or full moon clip and inserting it into the cylinder.

In addition the "speed loader" of the prior art is a large and cumbersome device, whic must be discarded immediately if in an emergency situation requiring quick use of the firearm, and of course must be retrieved after discharging the firearm.

In contrast the device of the present invention provides a means by which the clip holding device stays on the waistbelt or other belt, and only the half or full moon clip itself filled iwth cartridges is raised by the hands, thereby eliminating the existing cumbersome means of the "speed loader" of the prior art.

The device of the present invention improves upon the advantages of the existing half and full moon clips by providing a means to store in a uniform and organized manner an item which in the prior art was only loosely carried. This allows the uniform access to loaded half and full moon clips. And as can be seen from the question asked by the user in the magazine article Exhibit A, the half and full moon clips which can easily become deformed in their prior art usage without a uniform holder, can by utilizing the teaching of the present invention, eliminate this problem and extend the original preserved and undamaged condition of the clips and also increase the efficiency of easily utilizing the loaded clips because of their undeformed condition.

Because the device of the present invention has no moving parts, it is quicker and easier to use than devices of the prior art, having no knob to press or turn as in the "speed loader". In addition the device of the present invention requires no parts to be discarded in loading a filled half or full moon clip, and is therefore a more streamlined and efficient means.

The device of the present invention therefore teaches a new means, being the easiest, and fastest loading and reloading of cartridges which are held in full or half moon clips or speed loaders available to the present date.

In the prior art, in devices known as "speed loaders", and when the potential hazards of accidental release of cartridges occurs as abovementioned, if the device according to the present application is used, the cartridges may stay in the device of the instant application remaining in the provided recesses for the cartridges, thereby remaining available for use. Therefore in the case of a manual fumble, cartridges can still be easily accessible, and hand loaded manually. This provides for a "fail-safe" utilization of the device of the present invention in contrast to devices of the prior art.

In addition, the device of the instant application, teaches a device which uses a physically similar dexterity to that already known by a person skilled in loading typical cartridges. The physical map of the time-motion steps needed to utilize the device of the instant application is already familiar to one skilled in loading cartridges. Therefore the device is easy and familiar to use.

Further objects and advantages are to provide an attachment means to connect the holding device of the present invention to convenient belts, by positive means of attachment as required, allowing easy removal as necessary. Still further objects and advantages will become apparent from a consideration of the ensuing description and drawings.

DRAWING FIGURES

EXHIBITS

Figure 3:
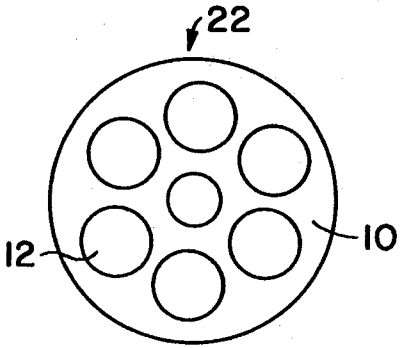
FIG. 3 is a plan view of the opposite end (bottom end) from FIG. 1.

Exhibit A is a question in an article from a recent firearm periodical showing the long felt but unfulfilled need which is resolved by the teaching of the present invention, in which an expert in the prior art offers no material suggestion which would anticipate the teaching of the present invention for uniform holding of half or full moon clips.

REFERENCE NUMERALS IN DRAWINGS

10: base of holding device
12: holes to receive cartridges
14: magnets at central wheel
16: central wheel
16A: flat top of central wheel
18: cartridge
20: half or full moon clip
22: device of present invention
24: line of central recess
26: central recess
28: magnetic means
32: metallic means.

DESCRIPTION

FIGS. 1 to 7

Figure 2:
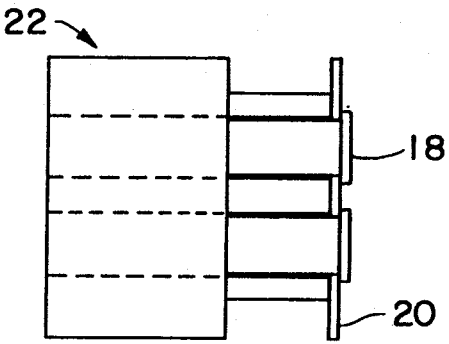
FIG. 2 is a side view taken across line A—A in FIG. 1 and showing cartridges in place.
Figure 5:
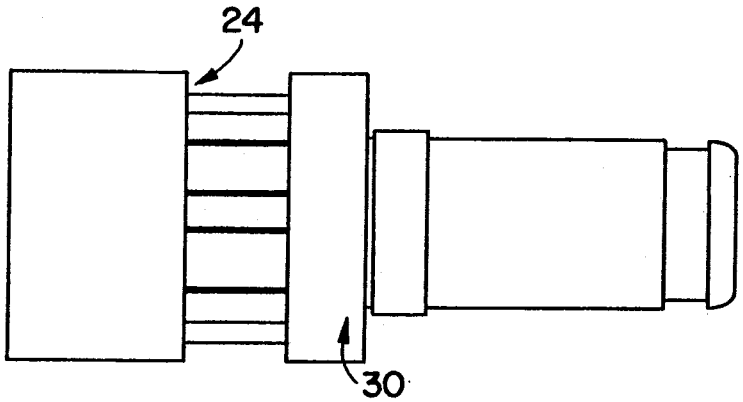
FIG. 5 is a side view taken across line 5—5 in FIG. 4.
Figure 1:
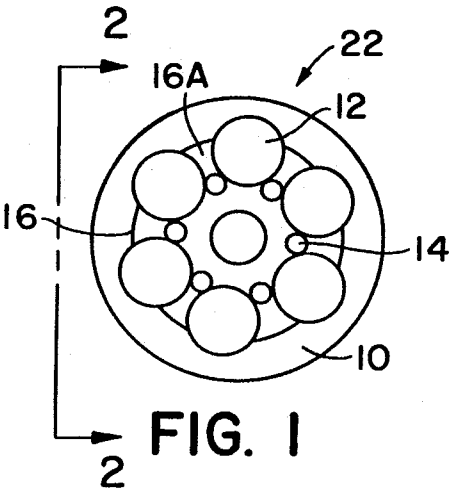
FIG. 1 is a plan view of the full or half moon clip attachment end (top end) of the present invention.

A typical embodiment of the holder 22 of the present invention is illustrated in FIG. 1 (end view) and FIG. 2 (side view).

The holder has a wide base 10 consisting of a rigid material. A hexagonal pattern of appropriately sized holes 12 are located within base 10, allowing for passage of a typical cartridge layout.

A central wheel 16 having appropriate height to allow nesting of cartridges 18 through holes 12, and having a diameter stopping near the center of the perimeters of holes 12 is located about the center of the device, and has a flat top 16A being formed of a rigid material. Embedded in the flat top 16A are magnets 14 which receive and hold in place abutted half or full moon clips 20 filled with cartridges 18.

Figure 4:
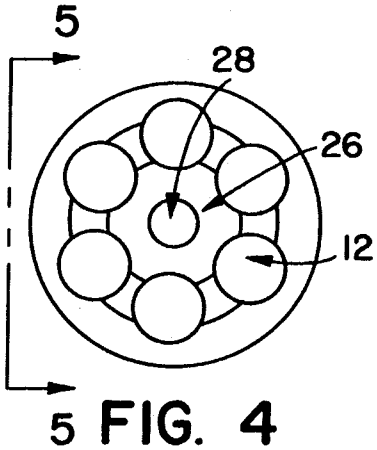
FIG. 4 is a plan view of the speed loader type holding device attachment end(top end).
Figure 6:
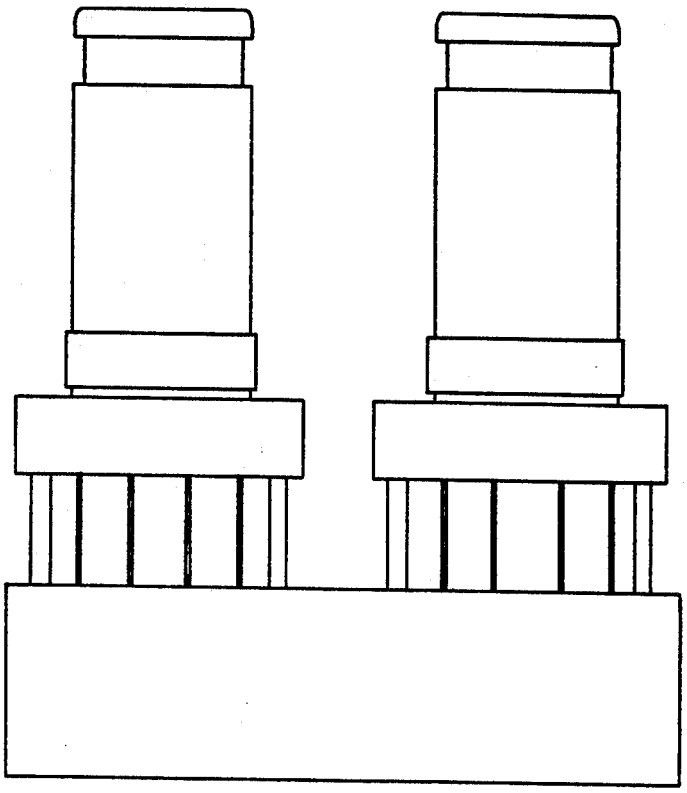
FIG. 6 is an elevational view of two of said holding devices fused into a single structure.
Figure 7:
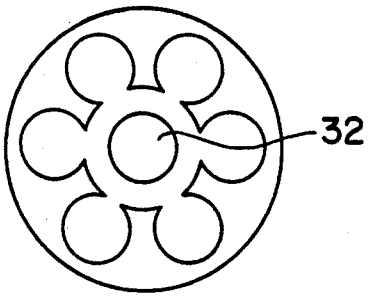
FIG. 7 is an end view of an additional metallic means attached to a cartridge holding device at its center.

An alternate embodiment of the device of the present invention is shown in FIG. 4, which is a plan view showing a central recess 26 and magnetic means 28, which allows for the seating and magnetic bond of a "speed loader" of the prior art into the device of the instant application when the speed loader, FIG. 7 is fitted with a metallic means 32 at its center.

OPERATION

FIGS. 1-7

The loaded half or full moon clips 20 are inserted into the holding device, which is designed to be worn on a persons belt. The moon clips are held in place by magnets 14 which are permanently secured within the flat top 16A of the holding device.

The half or full moon clips are typically manufactured from steel which allows for a strong magnetic bond between the clips and the holding device due to the magnets permanently secured to the flat top 16A of the central wheel 16.

The magnetic bond between the loaded half or full moon clip and the holding device is sufficient to allow the user to engage in strenuous activities such as running, jumping etc. without dislodging the loaded clip from the holding device.

Then, when needed for a rapid loading or reloading of an empty firearm, the magnetic bond between the loaded clip 20 and the holding device 22 through the magnets 14 can be easily overcome by grasping the exposed edge of the clip 20 with the fingers and pulling upward. The loaded half or full moon clips are then inserted in their entirety into the firearms open cylinder.

The cylinder is then closed and the firearm is ready for use or reuse in the shortest time possible.

The holding devices according to the present invention can be utilized with any firearm manufactured or modified to fire cartridges held by half or full moon clips, or speed loaders.

The loaded speed loader is inserted into the holding device 6, and the central metallic means 30 of the speed loader, FIG. 7 comes into contact with the recessed magnetic means 28, is thereby securely attached to the device of the present invention and is seated in the central recess 26, as the cartridges also seat in their holes 12.

Then, when needed for rapid loading or reloading of an empty firearm, the magnetic bond 28 between the speed loader and the holding device 6, can be easily overcome by grasping and lifting the speed loader away from the holding device according to the present invention.

SUMMARY, RAMIFICATIONS, AND SCOPE

Accordingly, the reader will see that the magnetic holding device of this invention can be used to uniformly and securely hold in place typically on a belt, loaded half or full moon clips and speed loaders, allowing easy and efficient access for loading and reloading. Furthermore, the holding device has the additional advantages in that it permits the loading and reloading of a full cylinder of cartridges with either full or half-moon clips or speed loaders of the prior art.

it permits the fastest loading and reloading of a full cylinder of cartridges to date by using only a hand reaching to the holder of the present invention, grasping and raising a half or full moon clip of speed loader which is then directly placed into the cylinder.

it permits a uniform means for storage and retrieval of filled half and full moon clips and speed loaders. In addition it eliminates the prior problem of bending and damaging the clips when stored in pockets and in other loose means.

Although the description above contains many specifications, these should not be construed as limiting the scope of the invention but as merely providing illustrations of some of the presently preferred embodiments of this invention. For example, the holding device may be made from either hard plastic or metal or other rigid materials. The holder may be formed of many different appropriate dimensions and holes to allow for the usage of cartridges of different calibers of the different full and half moon clips and speed loaders available. The overall shape of the holder may extend laterally to form a single holder holding several loaded half or full moon clips, or two holders may be joined at their base ends to form a multiple holder. Thus the scope of the invention should be determined by the appended claims and their legal equivalents, rather than by the examples given.

Informal drawings are included and will be formalized as required upon allowance.

I claim:

1. A holding device for storage and retrieval of filled firearm moon cartridge holding clips and speed loaders the device comprising, a substantially cylindrical base having an axial length and containing holes appropriately sized and spaced to receive the partial length passage of cartridges held in said moon cartridge holding clips and speed loaders, a substantially cylindrical central means having its diameter extend to approximately the center of the perimeters of said holes in said base thereby having a diameter less than the diameter of said cylindrical base, said cylindrical central means having at least partially circular openings corresponding substantially to the diameter size of said cartridges said partially circular openings located substantially at the perimeter of said central means, said cylindrical central means having an axial length and openings appropriately sized and spaced to receive the passage of the remaining partial length of cartridges held by said holding device, said cylindrical central means having a substantially flat top end surface formed as required to receive abutted against it cartridge holding devices, said cylindrical central means having a magnetic means embedded in it forming a magnetic bond between said central means and an abutted cartridge holding device.

2. The device according to claim 1 wherein at least two of said holding devices are fused in a single means being a laterally elongate substantially cylindrical device.

3. The device according to claim 1 wherein an additional metallic means is attached to a cartridge holding device at its center allowing for the said abutment of said magnetic bond between said magnetic means in said central means and said cartridge holding device.

4. The device according to claim 1 in which said embedded magnetic means is a single magnet located at a recessed center of said central means.

5. The device according to claim 1 in which said embedded magnetic means is multiple magnets located on the top end of the central means about a central radius.

* * * * *